US010018307B2

(12) United States Patent
Ortmann et al.

(10) Patent No.: US 10,018,307 B2
(45) Date of Patent: Jul. 10, 2018

(54) THERMAL MANAGEMENT SYSTEM FOR A NATURAL GAS TANK

(71) Applicant: GM Global Technology Operations LLC, Detroit, MI (US)

(72) Inventors: Jerome P. Ortmann, Sterling Heights, MI (US); Mahmoud H. Abd Elhamid, Troy, MI (US); Arianna T. Morales, Royal Oak, MI (US); Anne M. Dailly, West Bloomfield, MI (US); Mei Cai, Bloomfield Hills, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 86 days.

(21) Appl. No.: 14/223,065

(22) Filed: Mar. 24, 2014

(65) Prior Publication Data

US 2014/0290283 A1 Oct. 2, 2014

Related U.S. Application Data

(60) Provisional application No. 61/806,149, filed on Mar. 28, 2013.

(51) Int. Cl.

| | |
|---|---|
| ***F25B 21/02*** | (2006.01) |
| ***F17C 13/00*** | (2006.01) |
| ***F17C 13/02*** | (2006.01) |

(52) U.S. Cl.

CPC ..... *F17C 13/002* (2013.01); *F17C 13/026* (2013.01)

(58) Field of Classification Search

CPC .... F17C 13/002; F17C 13/026; F17C 13/003; B60T 2210/36; B67D 2007/0465; B67D 7/80; B67D 2007/0455; B60H 1/00771

USPC ..... 62/3.2

See application file for complete search history.

(56) References Cited

U.S. PATENT DOCUMENTS

| | | | | |
|---|---|---|---|---|
| 5,868,122 | A | 2/1999 | Gram et al. | |
| 7,377,294 | B2 | 5/2008 | Handa | |
| 7,681,604 | B2 | 3/2010 | Handa | |
| 7,735,528 | B2 | 6/2010 | Handa | |
| 8,125,346 | B2 * | 2/2012 | Ballard | G01D 11/28 340/438 |

(Continued)

FOREIGN PATENT DOCUMENTS

| | | |
|---|---|---|
| CN | 101535709 A | 9/2009 |
| CN | 102195054 | 9/2011 |

(Continued)

OTHER PUBLICATIONS

Third Office Action for Chinese Application No. 201410121481.1 dated Sep. 20, 2016 with English language translation; 15 pages.

*Primary Examiner* — Frantz Jules
*Assistant Examiner* — Steve Tanenbaum
(74) *Attorney, Agent, or Firm* — Harness, Dickey & Pierce, P.L.C.

(57) ABSTRACT

A thermal management system for a natural gas tank includes a container, and a cooling mechanism operatively positioned to selectively cool the container. A method for minimizing a loss of natural gas storage during refueling is also disclosed herein. In an example of the method, a cooling mechanism, which is operatively positioned to selectively cool a container of a natural gas storage tank, is initiated prior to a refueling event. This cools the container to a predetermined temperature.

15 Claims, 4 Drawing Sheets

(56) References Cited

U.S. PATENT DOCUMENTS

| | | | | |
|---|---|---|---|---|
| 2004/0250551 | A1* | 12/2004 | Schnagl | F17C 3/00 62/45.1 |
| 2007/0000561 | A1* | 1/2007 | Handa | F17C 5/007 141/82 |
| 2008/0056328 | A1* | 3/2008 | Rund | G01K 3/00 374/102 |
| 2008/0079606 | A1* | 4/2008 | Spare | F17C 13/025 340/870.16 |
| 2008/0302504 | A1* | 12/2008 | Handa | F17C 5/007 165/47 |
| 2009/0283427 | A1* | 11/2009 | Farone | F17C 11/007 206/0.7 |
| 2009/0287028 | A1* | 11/2009 | Iwasaki | C07B 61/00 585/15 |
| 2010/0084112 | A1* | 4/2010 | Piccard | B60H 1/004 165/41 |
| 2010/0089070 | A1* | 4/2010 | Allgeier | B60H 1/00492 62/45.1 |
| 2013/0045870 | A1* | 2/2013 | Rogers | B65D 88/125 505/163 |

FOREIGN PATENT DOCUMENTS

| | | | |
|---|---|---|---|
| CN | 102588730 | | 7/2012 |
| CN | 104075112 | A | 10/2014 |
| DE | 102014104183 | A1 | 10/2014 |
| KR | 1020040081902 | A * | 9/2004 |

* cited by examiner

THERMAL MANAGEMENT SYSTEM FOR A NATURAL GAS TANK

CROSS REFERENCE TO RELATED APPLICATION

This application claims the benefit of U.S. Provisional Patent Application Ser. No. 61/806,149 filed Mar. 28, 2013, which is incorporated by reference herein in its entirety.

BACKGROUND

Pressure vessels, such as, e.g., gas storage containers and hydraulic accumulators may be used to contain fluids under pressure. Some gas storage tanks are filled to a threshold pressure. The density of gases depends on the pressure and the temperature of the gas. For example, on a hot day, the gas will expand, and the tank may only fill to 75% (or less) of its potential. During refueling, the gas compresses into the tank and the temperature inside of the tank increases. As examples, in a high pressure system, the tank without an adsorbent may be filled at a pressure of about 3,600 psi and at a temperature of about 50° C. (≈122° F.), and the tank with an adsorbent may be filled at a pressure of about 3,600 psi and at a temperature of about 60° C. (≈140° F.). After fueling, the temperature of the tank decreases (e.g., to the ambient temperature), and the pressure also decreases proportionally. In an example, the tank pressure decreases to 3,400 psi and this amounts to a thermodynamically induced underfill of about 6%.

SUMMARY

A thermal management system for a natural gas tank includes a container, and a cooling mechanism operatively positioned to selectively cool the container. A method for minimizing a loss of natural gas storage during refueling is also disclosed herein. In an example of the method, a cooling mechanism, which is operatively positioned to selectively cool a container of a natural gas storage tank, is initiated prior to a refueling event. This cools the container to a predetermined temperature.

BRIEF DESCRIPTION OF THE DRAWINGS

Features and advantages of examples of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Figure 1:
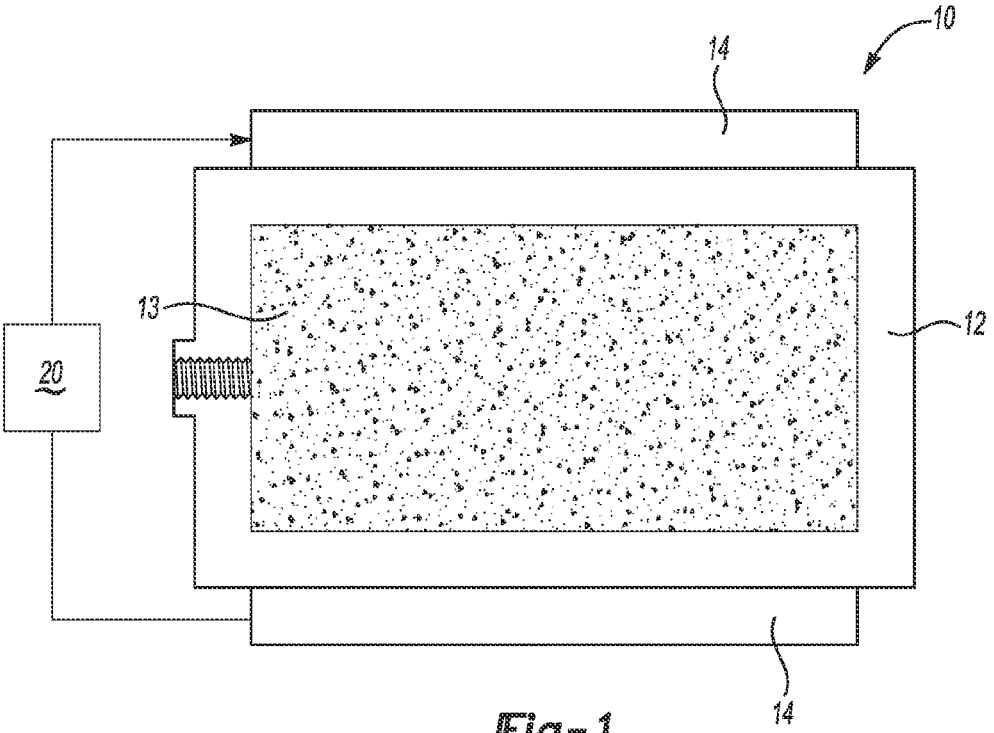
FIG. 1 is a schematic view of a natural gas tank including an example of a cooling mechanism according to the present disclosure.

Natural gas vehicles are fitted with on-board storage tanks Some natural gas storage tanks are designated low pressure systems, and these systems are rated for pressures up to about 750 psi. In an example, the low pressure systems are rated for pressures of about 725 psi and lower. During refueling, the container of the low pressure system storage tank is designed to fill until the tank achieves a pressure within the rated range. Other natural gas storage tanks are designated high pressure systems, and these systems are rated for pressures ranging from about 3,000 psi to about 3,600 psi. Similar to low pressure system storage tanks, the container of the high pressure system storage tank is designed to fill until the tank achieves a pressure within the rated range.

Both high and low pressure systems may utilize adsorbed natural gas, where a natural gas adsorbent is loaded into a container. The adsorbent may increase the storage capacity so that the tank is capable of storing and delivering a sufficient amount of natural gas for desired vehicle operation when filled to the rated pressures.

As used herein, refueling means the introduction of a quantity of natural gas into a container to increase the quantity of the natural gas in the container. Refueling of natural gas containers is typically accomplished by connecting the natural gas container to a high pressure source. The fuel flows from the high pressure source into the natural gas container. When the pressure difference between the source and the natural gas container is high, the flow rate is generally higher than when the pressure difference is small. At very high pressure differences, flow rate may be limited by the speed of sound. This may be called choked flow, or critical flow. As the natural gas container fills, the pressure difference is reduced. When the pressure difference becomes low, the flow rate slows. When the pressure of the natural gas inside the container equals the pressure of the source, the flow stops. However, it is typical for refueling to be terminated before the tank actually reaches the source pressure. Typically, refueling is terminated when the tank reaches a target pressure that is somewhat lower than the source pressure. In some cases, refueling may be terminated when the flow rate falls to a target flow rate. In some cases, the flow rate may be measured by a flow meter, in other cases, the flow rate may be estimated from a rushing sound caused by the flow.

Unlike liquid fuel, natural gas can expand and contract significantly depending on the gas pressure and the temperature. For example, on a hot day, the gas will expand, and the tank may only fill to 75% (or less) of its potential. During refueling, the natural gas compresses into the tank and the temperature of the natural gas inside of the tank increases. As examples, in a high pressure system, the tank without an adsorbent may be filled at a pressure of about 3,600 psi and at a temperature of about 50° C. (≈122° F.), and the tank with an adsorbent may be filled at a pressure of about 3,600 psi and at a temperature of about 60° C. (≈140° F.). After fueling, the temperature of the tank decreases (e.g., to the ambient temperature), and the pressure also decreases proportionally to the temperature. In an example, the tank pressure decreases to 3,400 psi and this amounts to a thermodynamically induced underfill of about 6%. As used herein, thermodynamically induced underfill means a difference between a mass of natural gas loaded into a container and a service capacity of the container. For example, some CNG containers may be rated at 3,600 psi. As used herein, the service capacity of the CNG container rated at 3,600 psi is the mass of the natural gas stored in the container at 3,600 psi and 25° C. (degrees Celsius).

In the examples disclosed herein, a cooling mechanism is operatively positioned to selectively cool the container prior to refueling. In an example, cooling may be continued throughout refueling so that the container is maintained at a target temperature. For example, the target temperature may be about 25° C. (77° F. (degrees Fahrenheit)). It is believed that the systems disclosed herein enable the temperature of the tank to be managed so that the thermodynamically induced underfill during refueling is eliminated or at least minimized. In the examples shown in FIGS. 1 and 2, the system 10 or 10' is a natural gas tank illustrated schematically with different examples of the thermal management system. Each of these systems will be described hereinbelow.

It is recognized that most existing natural gas fuel containers will naturally tend toward thermal equilibrium with their environment according to the second law of thermodynamics. As such, unless a tank is perfectly insulated, it will eventually cool by radiation, convection and conduction until thermal equilibrium with the environment is reached. However, in examples of the present disclosure, the cooling may be selectively accelerated, and the temperature of the container may be controlled.

In each example of the system 10, 10', the container 12 may be made of any material having a desirable thermal conductivity that is also suitable for a reusable pressure vessel ranging from about 500 psi to about 3,600 psi. Examples of suitable container 12 materials include aluminum alloys. Examples of the aluminum alloys include those in the 7,000 series, which have relatively high yield strength. One specific example includes aluminum 7075-T6 which has a tensile yield strength of 73,000 psi. Other examples of aluminum alloys include those in the 6,000 series. One specific example is aluminum 6061-T6 which has a tensile yield strength of 40,000 psi. It is to be understood that metallic containers other than aluminum may also be used. As an example, the container may be made of high strength low alloy steel (HSLA). Examples of high strength low alloy steel generally have a carbon content ranging from about 0.05% to about 0.25%, and the remainder of the chemical composition varies in order to obtain the desired mechanical properties.

Figure 2:
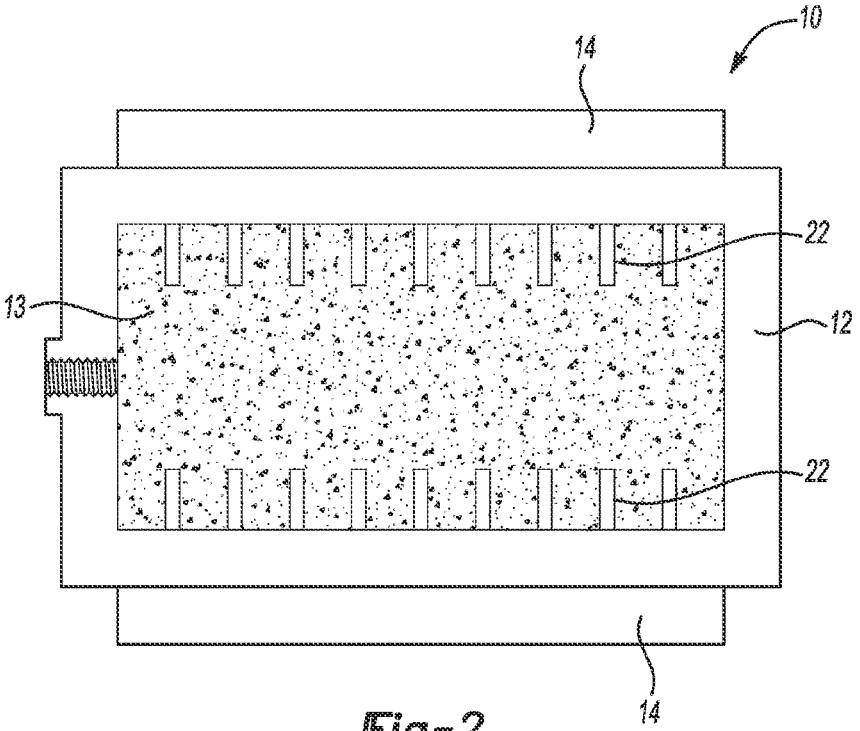
FIG. 2 is a schematic view of another example of the natural gas tank including an example of a cooling system with fins inside the container of the tank according to the present disclosure.

While the shape of the container 12 shown in FIGS. 1 and 2 is a rectangular canister, it is to be understood that the shape and size of the container 12 may vary depending, at least in part, on an available packaging envelope for the tank 10, 10' in the vehicle. For example, the size and shape may be changed in order to fit into a particular area of a vehicle trunk. As an example, the tank 10, 10' may be a cylindrical canister.

In the example shown in FIGS. 1 and 2, the container 12 is a single unit having a single opening or entrance. In each of these examples, the opening may be covered with a plug valve. While not shown, it is to be understood that the container 12 may be configured with other containers so that the multiple containers are in fluid (e.g., gas) communication through a manifold or other suitable mechanism.

As noted above, the examples disclosed herein may or may not include an adsorbent 13. In the examples shown in FIGS. 1 and 2, the natural gas adsorbent 13 is positioned within the container 12. Suitable adsorbents 13 are at least capable of releasably retaining methane (i.e., reversibly storing or adsorbing and desorbing methane molecules). In some examples, the selected adsorbent 13 may also be capable of reversibly storing other components found in natural gas, such as other hydrocarbons (e.g., ethane, propane, hexane, etc.), hydrogen gas, carbon monoxide, carbon dioxide, nitrogen gas, and/or hydrogen sulfide. In still other examples, the selected adsorbent 13 may be inert to some of the natural gas components and capable of releasably retaining other of the natural gas components.

In general, the adsorbent 13 has a high surface area and is porous. The size of the pores is generally greater than the effective molecular diameter of at least the methane compounds. In an example, the pore size distribution is such that there are pores having an effective molecular diameter of the smallest compounds to be adsorbed and pores having an effective molecular diameter of the largest compounds to be adsorbed. In an example, the adsorbent 13 has a Brunauer-Emmett-Teller (BET) surface area greater than about 50 square meters per gram ($m^2/g$) and up to about 2,000 $m^2/g$, and includes a plurality of pores having a pore size from about 0.2 nm (nanometers) to about 50 nm.

Examples of suitable adsorbents 13 include carbon (e.g., activated carbons, super-activated carbon, carbon nanotubes, carbon nanofibers, carbon molecular sieves, zeolite templated carbons, etc.), zeolites, metal-organic framework (MOF) materials, porous polymer networks (e.g., PAF-1 or PPN-4), and combinations thereof. Examples of suitable zeolites include zeolite X, zeolite Y, zeolite LSX, MCM-41 zeolites, silicoaluminophosphates (SAPOs), and combinations thereof. Examples of suitable metal-organic frameworks include HKUST-1, ZIF-8, MOF-74, and/or the like, which are constructed by linking tetrahedral clusters with organic linkers (e.g., carboxylate linkers).

The volume that the adsorbent 13 occupies in the container 12 will depend upon the density of the adsorbent 13. In an example, the density of the adsorbent 13 may range from about 0.1 g/cc to about 0.9 g/cc. A well packed adsorbent 13 may have a density of about 0.5 g/cc.

As mentioned above, the example systems 10, 10' include a cooling mechanism that is used to cool the container 12 to achieve a predetermined container temperature prior to refueling in order to minimize the loss of gas storage. Each of the cooling mechanisms will now be described.

Referring now specifically to FIG. 1, the cooling mechanism is a heat exchanger 14, 14'. The heat exchanger 14, 14' may circulate fluid around the container 12. The heat exchanger 14 may be operatively positioned on the exterior of the container 12, and the heat exchanger 14' may be positioned inside of the container 12 (shown in phantom in FIG. 1). The heat exchanger 14 transfers heat from the container 12 to the cool/cold coolant running through tubes positioned around the container 12. The cool/cold coolant is delivered to the heat exchanger 14 via fluid channels that are fluidly connected to a coolant circuit 20 of the vehicle. The coolant circuit 20 of the vehicle may be any coolant circuit that is capable of delivering coolant below at or below a desired refueling temperature. The coolant circuit 20 may be dedicated to the cooling of the container 12, or the coolant circuit 20 may have components that are shared with other vehicle systems. For example, the coolant circuit 20 may dissipate heat to the environment via a standalone heat exchanger. Heat from the container 12 may be transferred to the coolant by conduction.

Figure 3:
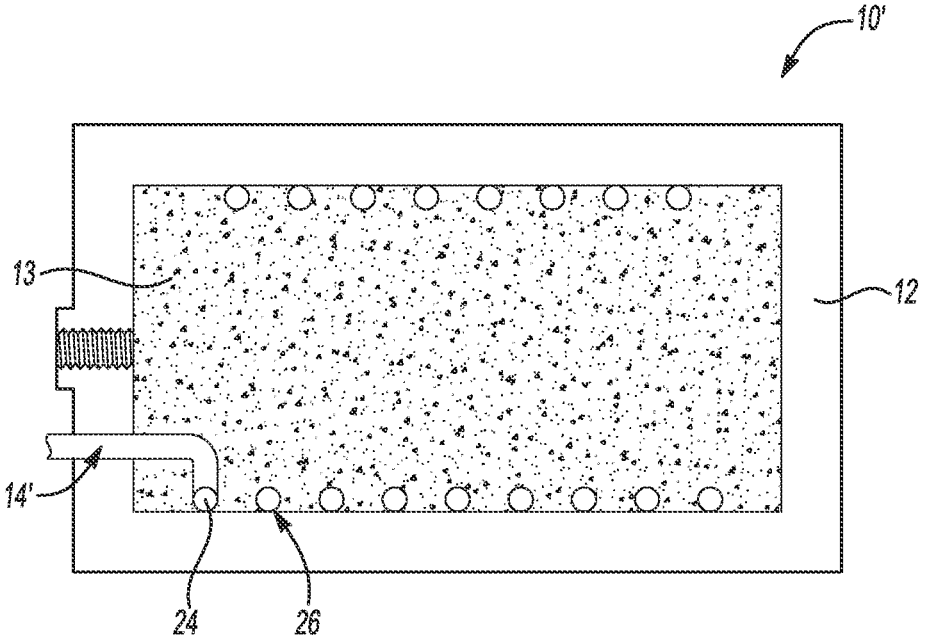
FIG. 3 is a schematic view of another example of the natural gas tank including an example of a cooling system with a helical coil inside the container of the tank according to the present disclosure.

As depicted in FIGS. 2 and 3, the transfer of heat from the container 12 may be enhanced by including aspects of the heat exchanger inside the container 12. For example, fins 22 may be included inside the container 12 as depicted in FIG. 2. In another example depicted in FIG. 3, coolant tubes 24 of the heat exchanger 14 may be routed inside the container 12. The heat exchanger 14' may be a helical coil heat exchanger which transfers heat from the container 12 to a helical coil 26 positioned in the container 12. Heat from the container 12 may be transferred to the helical coil 26 by conduction. The removal of heat from the container 12 advantageously reduces the container temperature prior to and during refueling.

Figure 4:
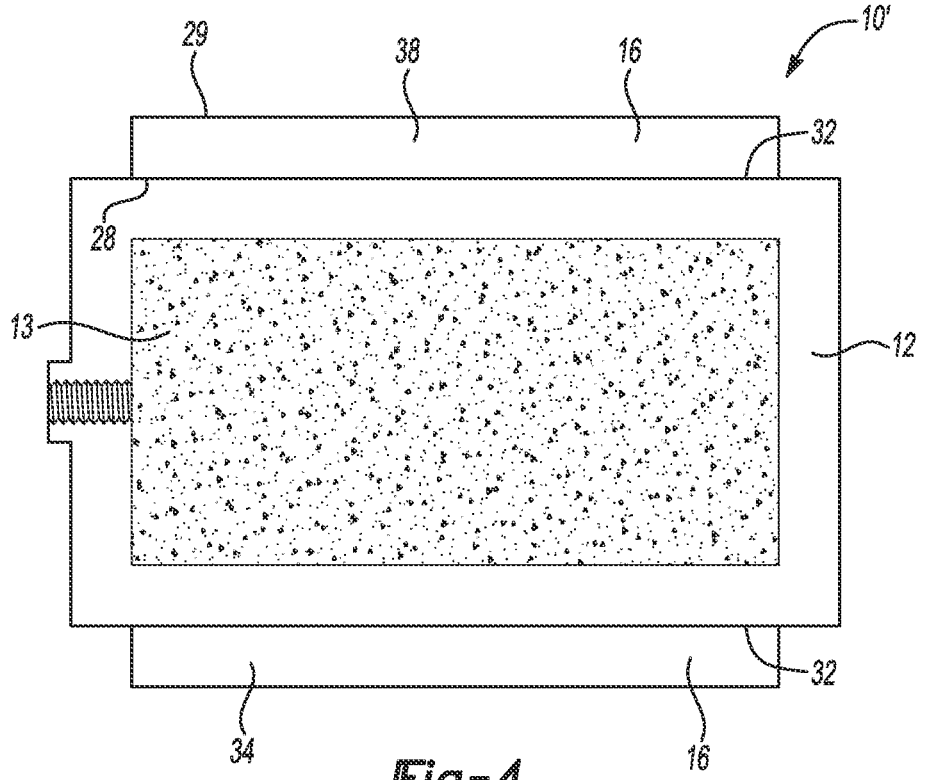
FIG. 4 is a schematic view of another example of the natural gas tank including an example of a cooling system with a Peltier cooler according to the present disclosure.
Figure 5:
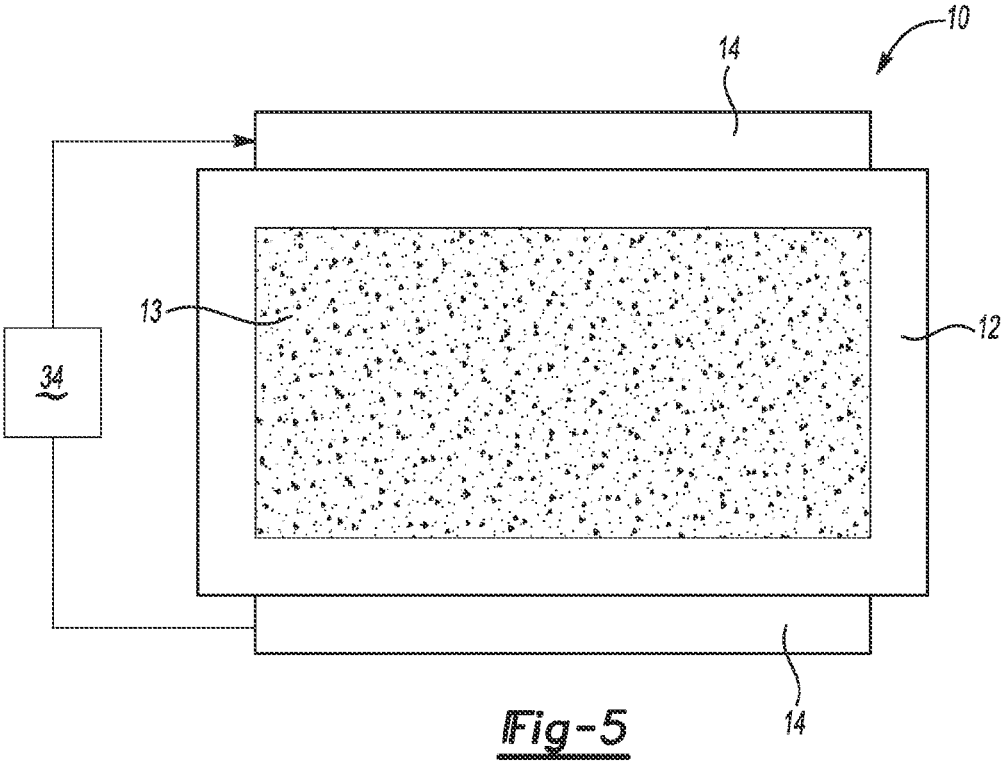
FIG. 5 is a schematic view of another example of the natural gas tank including an example of a cooling system with a phase change material according to the present disclosure.
Figure 6:
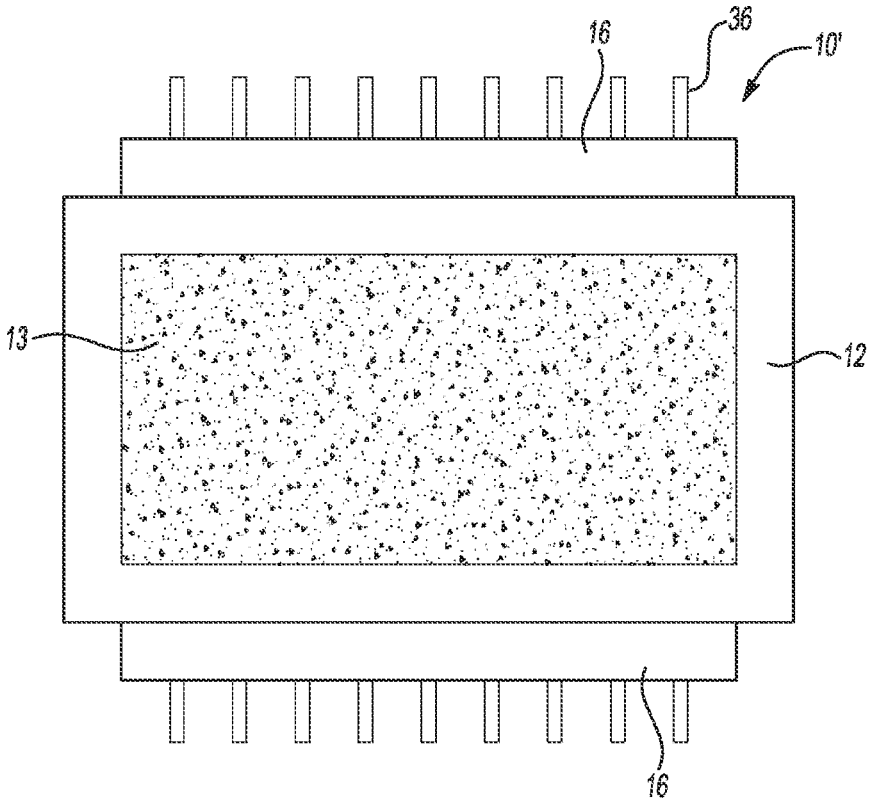
FIG. 6 is a schematic view of another example of the natural gas tank including an example of a cooling system with exterior fins according to the present disclosure.

Other examples of the cooling mechanism 16 are shown in FIGS. 4-6. Each of the examples depicted in FIGS. 4-6 has a cooling mechanism 16 positioned on the exterior of the container 12. One example of the cooling mechanism 16 is a Peltier cooler as depicted in FIG. 4. This mechanism has two sides, and when DC current flows through the mechanism, it brings heat from the side 28 adjacent to the container 12 to the other side 29 opposite the adjacent side 28, so that the side 28 adjacent to the container 12 gets cooler while the other side 29 gets hotter. The hot side 29 may be attached to a heat sink so that it remains at ambient temperature, while the cool side 28 may be cooled below the ambient temperature.

Another example of the cooling mechanism 16 includes Peltier modules 38 that rely on the Seebeck effect. These modules include dissimilar metals and a junction therebetween. The modules can be positioned on the exterior 32 of the container 12. The module junction is capable of producing an electric current when exposed to a temperature gradient. More specifically, the module is able to sense a temperature difference between the wall of the container 12 and the outside temperature, and attempts to balance both temperatures by generating electricity.

FIG. 5 depicts an example of the present disclosure having yet another example of the cooling mechanism 16. The cooling mechanism 16 depicted in FIG. 5 is a phase change material positioned in a heat exchanger 14 around the container 12. In this example, phase conversion is utilized, where, as a liquid refrigerant present in the cooling mechanism 16 converts to a gas, the refrigerant absorbs heat from the container 12. This example of the cooling mechanism 16 exploits the feature of phase conversion by forcing chemical compounds (e.g., refrigerants) to evaporate and condense over and over again in a closed system of coils. The heat adsorbed by evaporation of the refrigerant may be rejected via a condenser 34 remote from the heat exchanger 14 (evaporator).

Still another example of the present disclosure, depicted in FIG. 6, has a cooling mechanism 16 that includes fins 36 that increase a rate of heat rejection by the cooling mechanism 16 to the environment surrounding the cooling mechanism 16.

Figure 7:
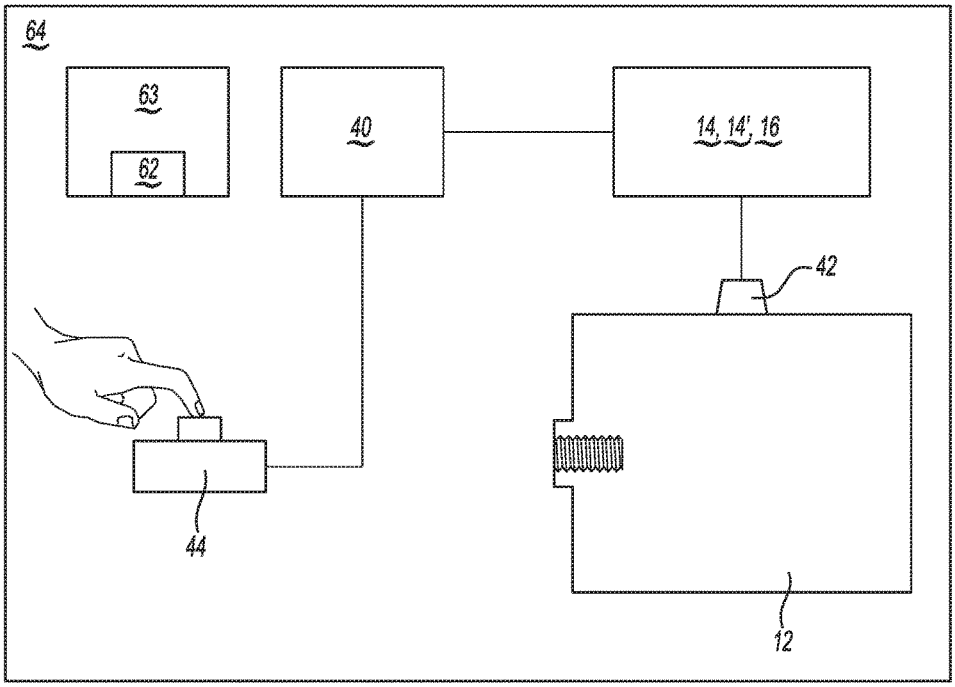
FIG. 7 is a schematic view of another example of the natural gas tank including an example of a cooling system with an electronic control system according to the present disclosure.

Any of the examples disclosed herein may include an electronic system, which includes a temperature sensor 42 to detect the temperature of the container 12 and an electronic control unit 40 operatively connected to the cooling mechanism 14, 14', 16 and to the temperature sensor 42 as depicted in FIG. 7. The temperature sensor 42 can detect when the container 12 temperature is above a desired refueling temperature (e.g., ranging from about 20° C. to about 25° C. or from about 68° F. to about 77° F.), and then in response to this detection, can communicate or transmit a signal to the electronic control unit 40. In response to receiving the signal, the electronic control unit 40 initiates the cooling mechanism 14, 14', 16. In another example, the cooling mechanism 14, 14', 16 may be initiated manually via a user interface 44 from within the vehicle 64 in communication with the electronic control unit 40 prior to a refueling event. In still another example, the electronic control unit 40 may be programmed to turn the cooling mechanism 14, 14', 16 on and off at suitable times.

A method for minimizing a thermodynamic underfill of a natural gas tank during refueling is disclosed herein. The method is a method of using the thermal management system disclosed herein. According to the method of the present disclosure, prior to a refueling event, a cooling mechanism 14, 14', 16 is initiated. The cooling mechanism 14, 14', 16 may be operatively positioned to selectively cool a container 12 of a natural gas storage tank, thereby cooling the container 12 to a predetermined temperature.

The method may further include determining a probability of commencement of refueling within a predetermined time interval via an electronic control unit in operative communication with the cooling mechanism 14, 14', 16 to control an operation of the cooling mechanism 14, 14', 16. If the probability exceeds a threshold probability, the cooling mechanism is initiated.

Determining the probability may include manually communicating to the electronic control unit 40 via a user interface 44 in communication with the electronic control unit 40 that the probability of commencement of refueling exceeds the threshold probability. For example, a user may press a button to cause the electronic control unit 40 to begin preparation for imminent refueling. The method may further include indicating that a thermal management system is preparing the container 12 for refueling and indicating a state of readiness of the container 12 for minimizing a thermodynamic underfill of the natural gas tank. For example, a display 62 in an instrument cluster 63 of a vehicle 64 may display messages indicating the status of the thermal management system and the status of the container 12. For example, the display 62 may indicate that the system is being prepared for refueling, or that the natural gas tank will be best prepared for storing an optimum amount of fuel with a countdown timer and/or analog or digital gauge. In an example of the method disclosed herein, the state of readiness may be 100 percent when a temperature of the container 12 is less than or equal to the predetermined temperature. Determining the probability may include automatically determining a state of fill of the container 12 by the electronic control unit 40. Determining the probability may also include automatically determining a proximity to a refueling station. For example, the electronic control unit 40 may be able to determine when the fill level is low, and using a Global Positioning System (GPS) determine, based on history of refueling, that refueling is likely to begin soon.

It is to be understood that the ranges provided herein include the stated range and any value or sub-range within the stated range. For example, a range from about 0.1 g/cc to about 0.9 g/cc should be interpreted to include not only the explicitly recited limits of about 0.1 g/cc to about 0.9 g/cc, but also to include individual values, such as 0.25 g/cc, 0.49 g/cc, 0.8 g/cc, etc., and sub-ranges, such as from about 0.3 g/cc to about 0.7 g/cc; from about 0.4 g/cc to about 0.6 g/cc, etc. Furthermore, when "about" is utilized to describe a value, this is meant to encompass minor variations (up to +/−10%) from the stated value.

In describing and claiming the examples disclosed herein, the singular forms "a", "an", and "the" include plural referents unless the context clearly dictates otherwise.

It is to be understood that the terms "connect/connected/connection" and/or the like are broadly defined herein to encompass a variety of divergent connected arrangements and assembly techniques. These arrangements and techniques include, but are not limited to (1) the direct communication between one component and another component with no intervening components therebetween; and (2) the communication of one component and another component with one or more components therebetween, provided that the one component being "connected to" the other component is somehow in operative communication with the other component (notwithstanding the presence of one or more additional components therebetween).

Furthermore, reference throughout the specification to "one example", "another example", "an example", and so forth, means that a particular element (e.g., feature, structure, and/or characteristic) described in connection with the example is included in at least one example described herein, and may or may not be present in other examples. In addition, it is to be understood that the described elements for any example may be combined in any suitable manner in the various examples unless the context clearly dictates otherwise.

While several examples have been described in detail, it will be apparent to those skilled in the art that the disclosed examples may be modified. Therefore, the foregoing description is to be considered non-limiting.

What is claimed is:

1. A thermal management system for a natural gas tank, comprising:

a container;

a cooling mechanism operatively positioned to selectively cool the container prior to refueling;

an electronic control unit in operative communication with the cooling mechanism to control an operation of the cooling mechanism;

a temperature sensor to detect a temperature of the container and communicate the temperature to the electronic control unit; and a GPS unit in operative communication with the electronic control unit, wherein the electronic control unit is configured to (i) determine a probability of refueling based on input from the GPS unit and (ii) control operation of the cooling mechanism to initiate cooling when the probability of refueling exceeds a threshold probability.

2. The thermal management system as defined in claim 1 wherein the cooling mechanism is a heat exchanger that circulates fluid around the container.

3. The thermal management system as defined in claim 1 wherein the cooling mechanism is a Peltier cooler.

4. The thermal management system as defined in claim 1 wherein the cooling mechanism is a heat exchanger that includes a helical coil.

5. The thermal management system as defined in claim 1 wherein the cooling mechanism is a phase change material positioned around the container.

6. The thermal management system as defined in claim 1 wherein the cooling mechanism includes a junction of dissimilar metals that is to produce an electric current when exposed to a temperature gradient.

7. The thermal management system as defined in claim 1, further comprising a natural gas adsorbent positioned in the container, wherein the natural gas adsorbent is selected from the group consisting of a carbon, a porous polymer network, a metal-organic framework, a zeolite, and combinations thereof.

8. The thermal management system as defined in claim 7 wherein the natural gas adsorbent has a Brunauer-Emmett-Teller (BET) surface area of greater than about 50 $m^2/g$ and less than or equal to about 2,000 $m^2/g$.

9. The thermal management system as defined in claim 7 wherein the natural gas adsorbent includes a plurality of pores having a pore size from about 0.2 nm to about 50 nm.

10. The thermal management system as defined in claim 1, further comprising a user interface in communication with the electronic control unit for manually initiating the cooling mechanism.

11. The thermal management system as defined in claim 1 wherein the display includes a countdown timer to indicate when the natural gas tank will be ready to minimize a thermodynamic underfill of the natural gas tank during refueling.

12. The thermal management system as defined in claim 1 wherein the display includes an analog or digital gauge to indicate when the natural gas tank will be ready to minimize a thermodynamic underfill of the natural gas tank during refueling.

13. The thermal management system as defined in claim 1, further comprising a display in an instrument cluster of a vehicle to display messages indicating a status of the thermal management system wherein the status of the thermal management system includes a state of preparing for refueling.

14. The thermal management system as defined in claim 1 wherein the electronic control unit is configured to determine the probability of refueling based on the input from the GPS and a history of refueling.

15. The thermal management system as defined in claim 1 wherein the container comprises a 7,000 series aluminum alloy, a 6,000 series aluminum alloy, or a high strength low alloy steel (HSLA).

* * * * *